US008686915B2

(12) United States Patent
Kanazawa et al.

(10) Patent No.: US 8,686,915 B2
(45) Date of Patent: Apr. 1, 2014

(54) ANTENNA DEVICE AND WIRELESS COMMUNICATION APPARATUS

(75) Inventors: Masaru Kanazawa, Kawasaki (JP); Kouji Soekawa, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 360 days.

(21) Appl. No.: 13/093,312

(22) Filed: Apr. 25, 2011

(65) Prior Publication Data

US 2012/0050129 A1 Mar. 1, 2012

(30) Foreign Application Priority Data

Aug. 27, 2010 (JP) ..... 2010-190844

(51) Int. Cl.
*H01Q 1/48* (2006.01)

(52) U.S. Cl.
USPC ..... 343/848; 370/349; 455/57.5

(58) Field of Classification Search
USPC ..... 343/848; 370/349; 455/575.7, 57.5
See application file for complete search history.

(56) References Cited

U.S. PATENT DOCUMENTS

| | | | | |
|---|---|---|---|---|
| 7,058,434 | B2 * | 6/2006 | Wang et al. | 455/575.7 |
| 2008/0246691 | A1 | 10/2008 | Yoshie | |
| 2010/0111143 | A1 | 5/2010 | Nishikido et al. | |
| 2010/0329235 | A1 * | 12/2010 | Trotter et al. | 370/349 |

FOREIGN PATENT DOCUMENTS

| | | | |
|---|---|---|---|
| JP | 9-046117 | A | 2/1997 |
| JP | 2005-064792 | A | 3/2005 |
| JP | 2006-166261 | A | 6/2006 |
| JP | 2008-017047 | A | 1/2008 |
| JP | 2008-258883 | A | 2/2008 |
| JP | 2008-167420 | A | 7/2008 |

* cited by examiner

*Primary Examiner* — Karl D Frech

(74) *Attorney, Agent, or Firm* — Westerman, Hattori, Daniels & Adrian, LLP

(57) ABSTRACT

An antenna device includes a board made of dielectric material, having first and second power feed parts; a first antenna element connected to the first power feed part, using a first wavelength; a second antenna element connected to the second power feed part, using a second wavelength; a ground formed on the board, having a first side and a second side respectively having different lengths and extending in different directions, the length of the first side, compared with the length of second side, which is approximate to a ¼ length of the first wavelength and a ¼ length of the second wavelength; and a parasitic element connected to the ground, which is not parallel to the first side of the ground, a length of the parasitic element is approximate to ¼ length of the second wavelength and an interval of the parasitic element and the second power feed part is less than equals the ¼ length of the second wavelength.

6 Claims, 11 Drawing Sheets

ANTENNA DEVICE AND WIRELESS COMMUNICATION APPARATUS

CROSS-REFERENCE TO RELATED APPLICATION(S)

This application is based upon and claims the benefit of priority of the prior Japanese Patent Application No. 2010-190844, filed on Aug. 27, 2010, the entire contents of which are incorporated herein by reference.

FIELD

The embodiments discussed herein relate to an antenna device and wireless communication apparatus.

BACKGROUND

It is known to reduce a correlation between antenna elements of an antenna device. Patent documents 1 to 3 discloses prior arts related to such an antenna device.

1. Japanese Laid-open Patent Publication No. 9-46117
2. Japanese Laid-open Patent Publication No. 2005-64792
3. Japanese Laid-open Patent Publication No. 2008-258883

SUMMARY

According to an aspect of the embodiments, an antenna device includes a board made of a dielectric material, having first and second power feed parts; a first antenna element connected to the first power feed part, using a first wavelength; a second antenna element connected to the second power feed part, using a second wavelength; a ground formed on the board, having a first side and a second side respectively having different lengths and extending in different directions, the length of the first side, compared with the length of second side, which is approximate to ¼ length of the first wavelength and ¼ length of the second wavelength; and a parasitic element connected to the ground, which is not parallel to the first side of the ground, a length of the parasitic element is approximate to ¼ length of the second wavelength and an interval of the parasitic element and the second power feed part is not more than the ¼ length of the second wavelength.

The object and advantages of the embodiment will be realized and attained by means of the elements and combinations particularly recited in the claims.

It is to be understood that both the foregoing general description and the following detailed description are exemplary and explanatory and are not restrictive of the embodiment, as claimed.

DESCRIPTION OF EMBODIMENTS

Figure 1A:
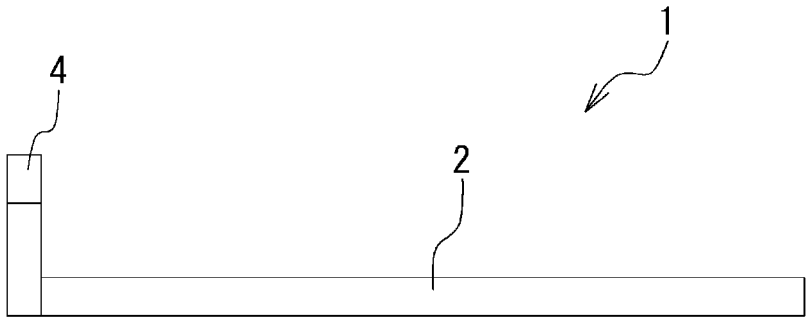
FIGS. 1A and 1B are illustrative views depicting an external view of an antenna device of a first embodiment.
Figure 1B:
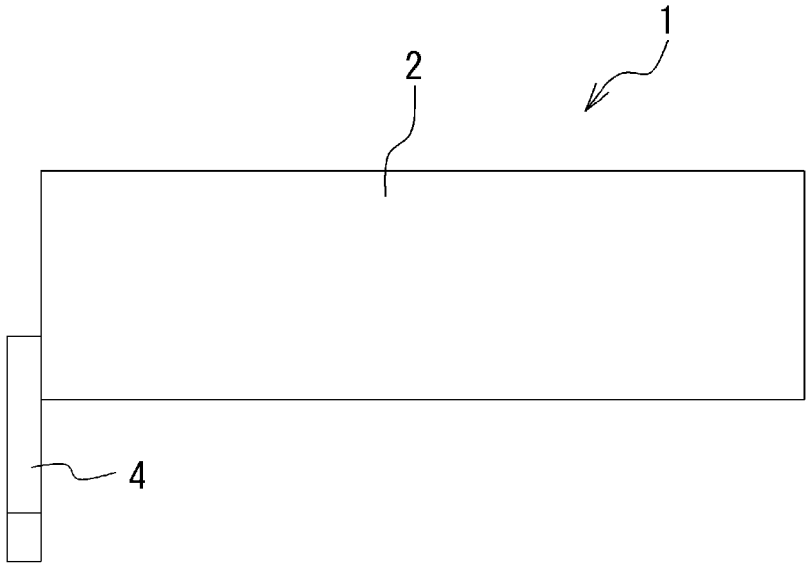

FIGS. 1A and 1B depict an external view of an antenna device of a first embodiment. Antenna device 1 includes body enclosure 2 and antenna enclosure 4. Antenna device 1 is card-shaped. Body enclosure 2 and antenna enclosure 4 are made of resin. In FIGS. 1A and 1B, antenna enclosure 4 is rotatable relative to body enclosure 2 and therefore can be raised from body enclosure 2. As detailed below, Antenna enclosure 4 contains an antenna element and body enclosure 2 contains a printed board on which the antenna element is formed.

Figure 2:
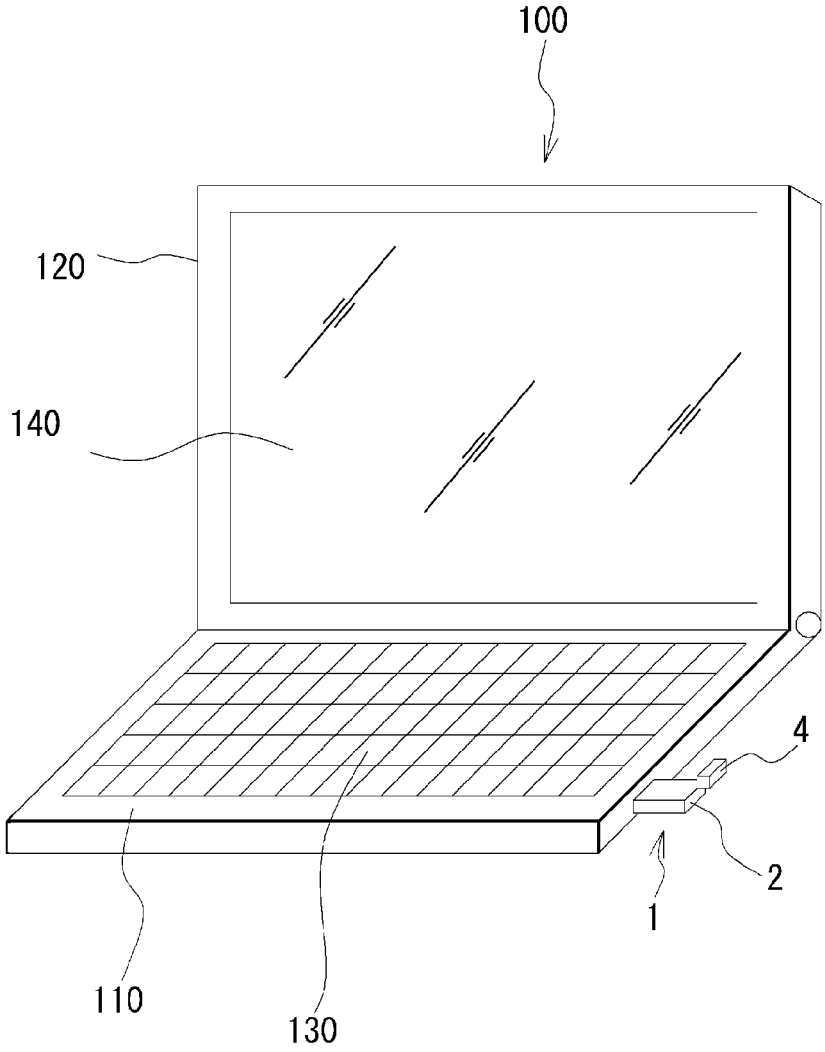
FIG. 2 is an illustrative view depicting a wireless communication apparatus in which the antenna device is mounted.

FIG. 2 depicts a wireless communication apparatus in which the antenna device is mounted. In FIG. 2, as an example of wireless communication apparatus 100, a portable notebook computer is illustrated. Wireless communication apparatus 100 includes main unit 110 and movable unit 120. Main unit 110 and movable unit 120 are connected so as to be opened and closed. Main unit 110 includes operation part 130. Movable unit 120 includes display 140. Main unit 110 operates communication apparatus 100. An edge of main unit 110 has a slot in which antenna device 1 is inserted. Antenna device 100 is inserted into the slot and then communication apparatus 100 is communicable.

Figure 3:
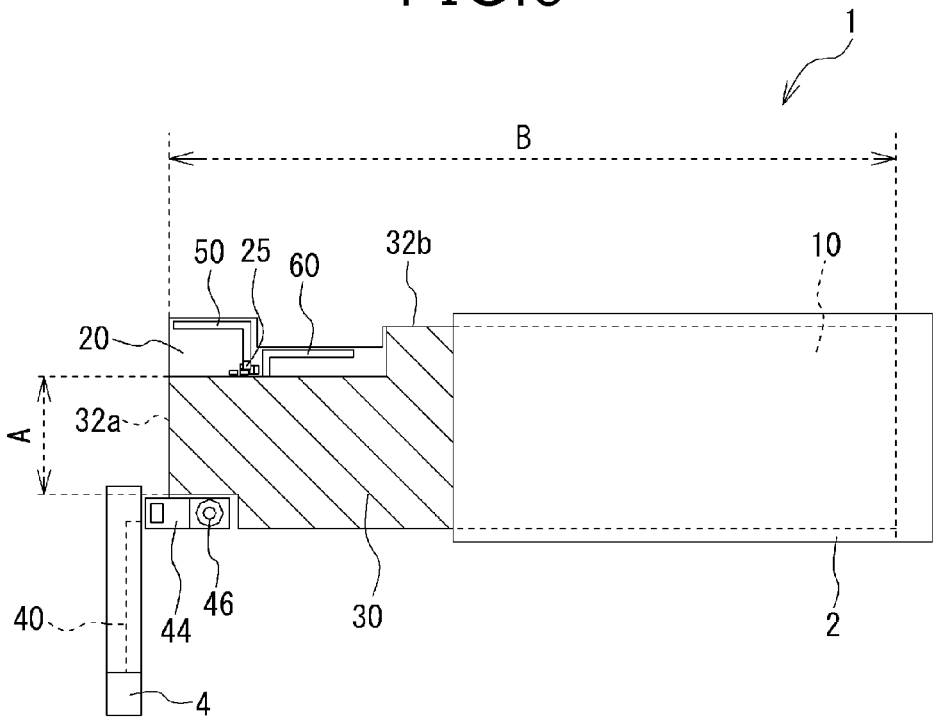
FIG. 3 is a view depicting an interior structure of the antenna device.

FIG. 3 depicts an interior structure of the antenna device. In FIG. 3, a part of body enclosure 2 is not illustrated. Body enclosure 2 contains a printed board 10. Printed board 10 is nearly rectangular. Printed board 10 includes support board 20 made of dielectric material and ground 30 formed on support board 20. Support board 20 is rigid in the embodiment but may be flexible.

Antenna enclosure 4 contains first antenna element 40. In a base of first antenna element 40, metal plate 44 is electrically connected to first antenna element 40. Metal plate 44 is connected to printed board 10 by bolt 46 and a nut (not shown). First antenna element 40 may be a rod type, a helical type or any other type.

Figure 4:
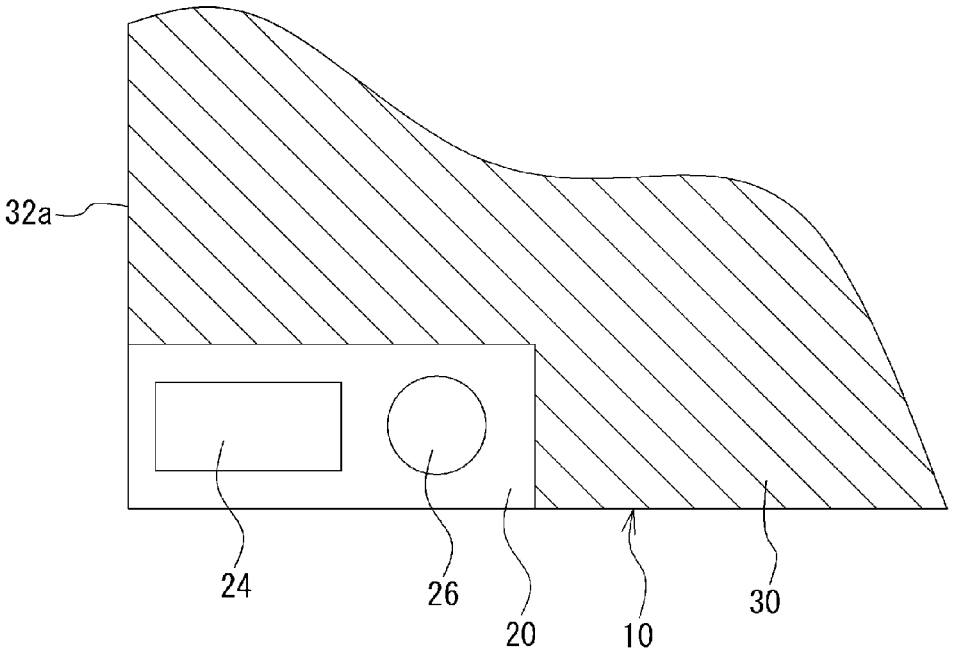
FIG. 4 is a view depicting a printed board without an antenna enclosure.

FIG. 4 depicts a printed board removing an antenna enclosure. Antenna enclosure 4 may be attached to a corner of printed board. Support board 20 has through hole 26 to insert bolt 46. Bolt 46 passes through to the other side. Further, support board 20 has first power feed part 24 to apply a current. The current is applied from first power feed part 24 to first antenna element 40 through metal plate 44.

As depicted in FIG. 3, on support board 20, second antenna element 50 and parasitic element 60 are formed, which elements may be formed by conductive patterns. Parasitic element 60 may be an L-shaped member. Second power feed part is arranged on support board 20. A current is applied from second feed part 25 to second antenna element 50. Second antenna element 50 is not electrically connected to ground 30. Parasitic element 60, which is not fed from power supply, is electrically connected to ground 30. It is noted that, in FIG. 3, power feed part 25 is illustrated on antenna element 50 for the purpose of facilitating understanding of the embodiment.

Ground 30 on support board 20 has short side 32*a* and long side 32*b*. Short side 32*a* and long side 32*b*, which are different in length, may extend in different directions and, especially, may be approximately orthogonal. Second antenna element 50, parasitic element 60 and second power feed part 25 are placed on a part other than ground 30 of support board 20. As illustrated in FIG. 3, short side 32*a* has length A and long side 32*b* has length B. For example, length A is 30 mm and length B is 100 mm, but not limited to the numerical values.

Figure 5:
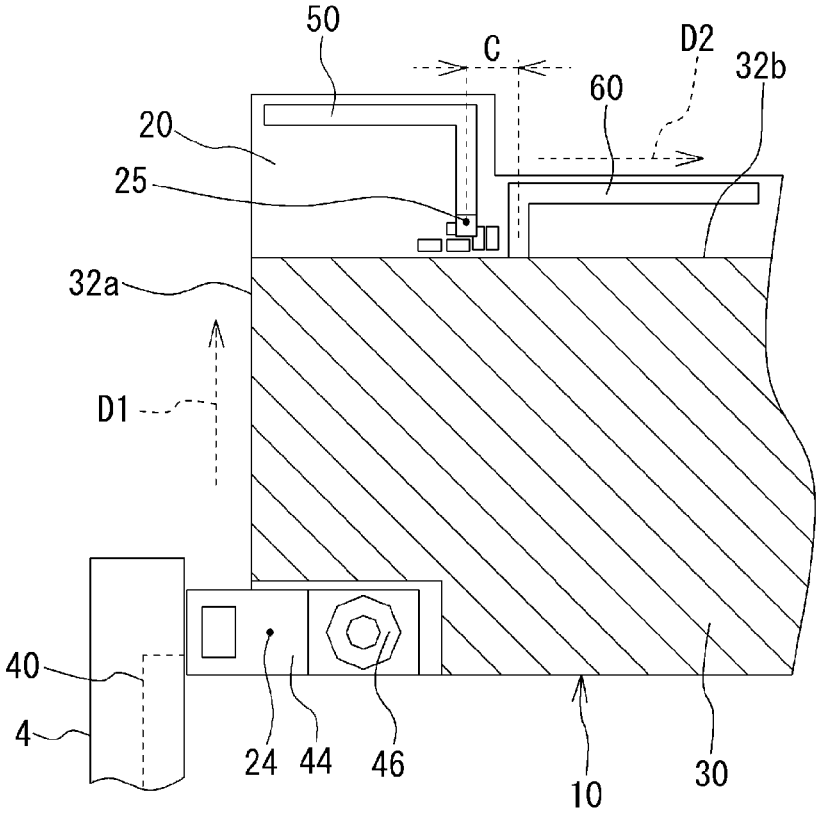
FIG. 5 is an illustrative view depicting antenna elements.

FIG. 5 is an illustrative view depicting antenna elements. First and second antenna elements 40 and 50 have the same working frequency of 2.0 GHz. A length of the antenna elements is set to approximately ¼ the wavelength of the wave having the working frequency. It should be noted that the "length" of the antenna elements is not an actual physical length, but electrical length adjusted based on a dielectric constant of support board 20. A wavelength equals to (wave velocity)/(frequency). Since the wave velocity is $3.0\times10^8$ m/s and the working frequency of first antenna element 40 is 2.0 GHz, the wavelength is 150 mm. ¼ of the wavelength is about 37 mm. Short side 32*a* is 30 mm long and long side 32*b* is 100 mm long. Consequently, a current on ground 30 flows along short side 32*a*, because short side 32*a* is more approximate to the ¼ wavelength than long side 32*b*. Thus, when a power is sent from first power feed part 24 to first antenna element 40, a current on ground 30 flows in direction D1. The current flows on the part of the ground, having a length corresponding to the ¼ wavelength. Accordingly, the sum of length of first antenna element 40 and length of the part of ground 30 on which the current flows is approximately the ½ wavelength. Consequently, first antenna element 40 cooperates with ground 30 to work as an antenna like a monopole antenna.

When a current is applied from second power feed part 25 to second antenna element 50, a current also flows in the direction D2 on parasitic element 60. A length of second antenna element 50 is set to approximately ¼ wavelength. Similarly, the length of parasitic element 60 is set to approximately ¼ wavelength. The sum of the length of second antenna element 50 and the length of parasitic element is approximately ½ wavelength. Consequently, second antenna element 50 cooperates with parasitic element 60 to work as an antenna such as a monopole antenna.

First and second antenna elements 40 and 50 may have respectively different working frequencies if the bandwidths of the working frequencies of first and second antenna elements 40 and 50 are overlapped.

Figure 6:
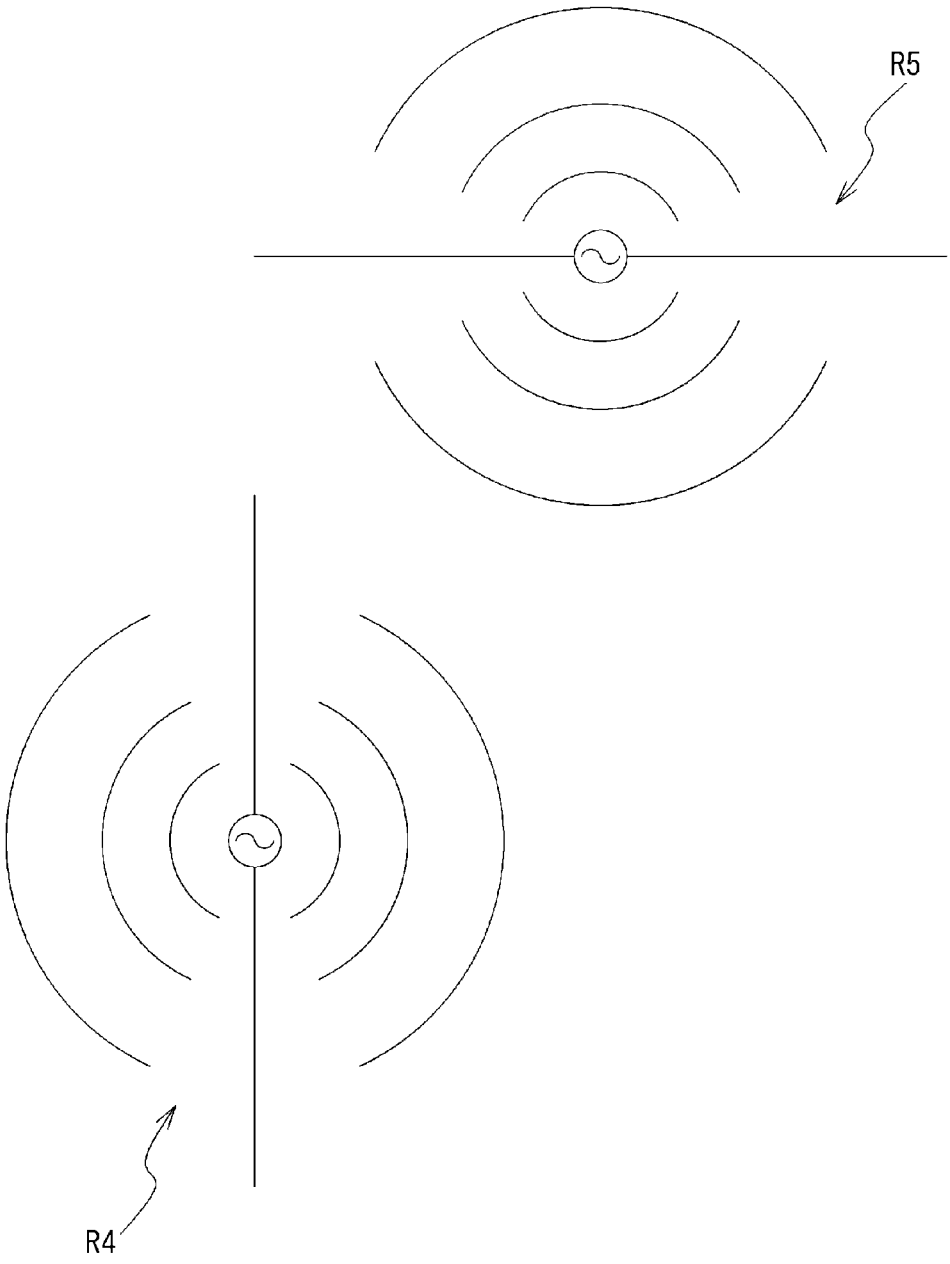
FIG. 6 is a view depicting an outline of a radiating pattern radiated by the antenna element.

FIG. 6 depicts an outline of a radiating pattern radiated by the antenna element. Radiating pattern R4 illustrates a radiating pattern radiated by first antenna element 40. Radiating pattern R5 illustrates a radiating pattern radiated by second antenna element 50. The radiating patterns R4 and R5 differs from each other. This is due to that direction D1 of the current on ground 30 is approximately perpendicular to direction D2 of the current on parasitic element 60.

Next, a comparison example will be described. For example, a ground, two power feed parts and two antenna elements respectively connected to the two power feed parts are formed on the board made of dielectric material, each of the two antenna element has a ¼ length of working wavelength of each antenna element. When a current is applied to one antenna element, a current flows through a part corresponding to ¼ of the wavelength in the ground. Consequently, the sum of the length of the current on the antenna element and the length of the current on the ground is ½ wavelength of the working antenna element. Thus, two antenna elements work as two antennas.

In general, a current in the ground flows along a side of the ground. Therefore, when two currents are applied on two antenna elements, currents in the ground can flow along the same side of the ground. A radiating pattern generated by the currents flowing on one antenna element and the ground may be similar to the other radiating pattern generated by the currents flowing on the other antenna element and the ground, and therefore the correlation between two antenna elements may increase.

Figure 7:
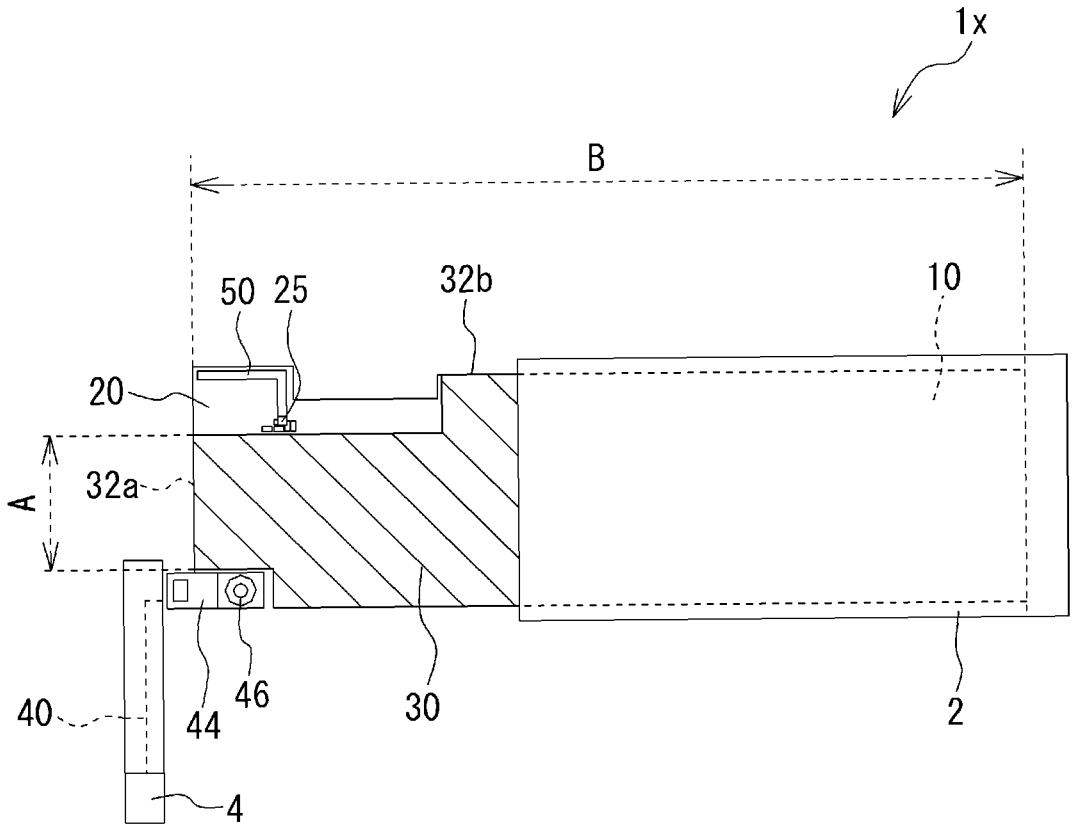
FIG. 7 is an illustrative view depicting an antenna device of a comparison example.
Figure 8:
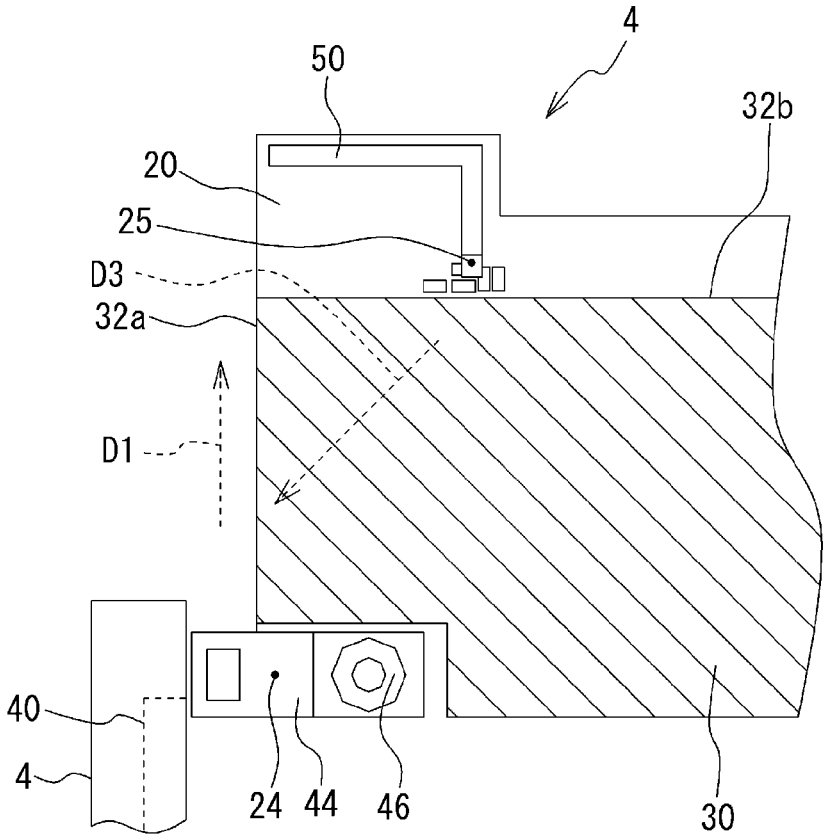
FIG. 8 is an enlarged view depicting an antenna device of the comparison example.

FIGS. 7 and 8 depict an antenna device of comparison examples. FIGS. 7 and 8 correspond to FIGS. 3 and 5. Reference numerals in FIGS. 7 and 8, which are the same as those in FIGS. 3 and 5, indicate the same elements or components.

In FIGS. 7 and 8, antenna device 1X does not have parasitic element 60 illustrated in FIGS. 3 and 5. Therefore, when a current is applied from second power feed part 25 to second antenna element, a current flows in the ground 30. The current in the ground 30 flows toward short side 32*a*.

Since the wave velocity is $3.0\times10^8$ m/s and the working frequency of second antenna element 50 is 2.0 GHz, the wavelength is 150 mm. The ¼ wavelength is about 37 mm. The short side is 30 mm long and the long side is 100 mm long. Consequently, a current in ground 30 flows along the short side, because the short side is more approximate to the ¼ wavelength than the long side. Thus, the current flows toward short side 32*a* rather than long side 32*b*.

As described above, when a current is applied from first power feed part 24 to first antenna element 40, a current on ground 30 flows in direction D1, i.e., along the short side 32*a*. As a result, first antenna element 40 cooperates with ground 30 to work as an antenna, and second antenna element 50 cooperates with ground 30 to work as an antenna. However, two currents flow along short side 32*a* in ground 30.

Figure 9:
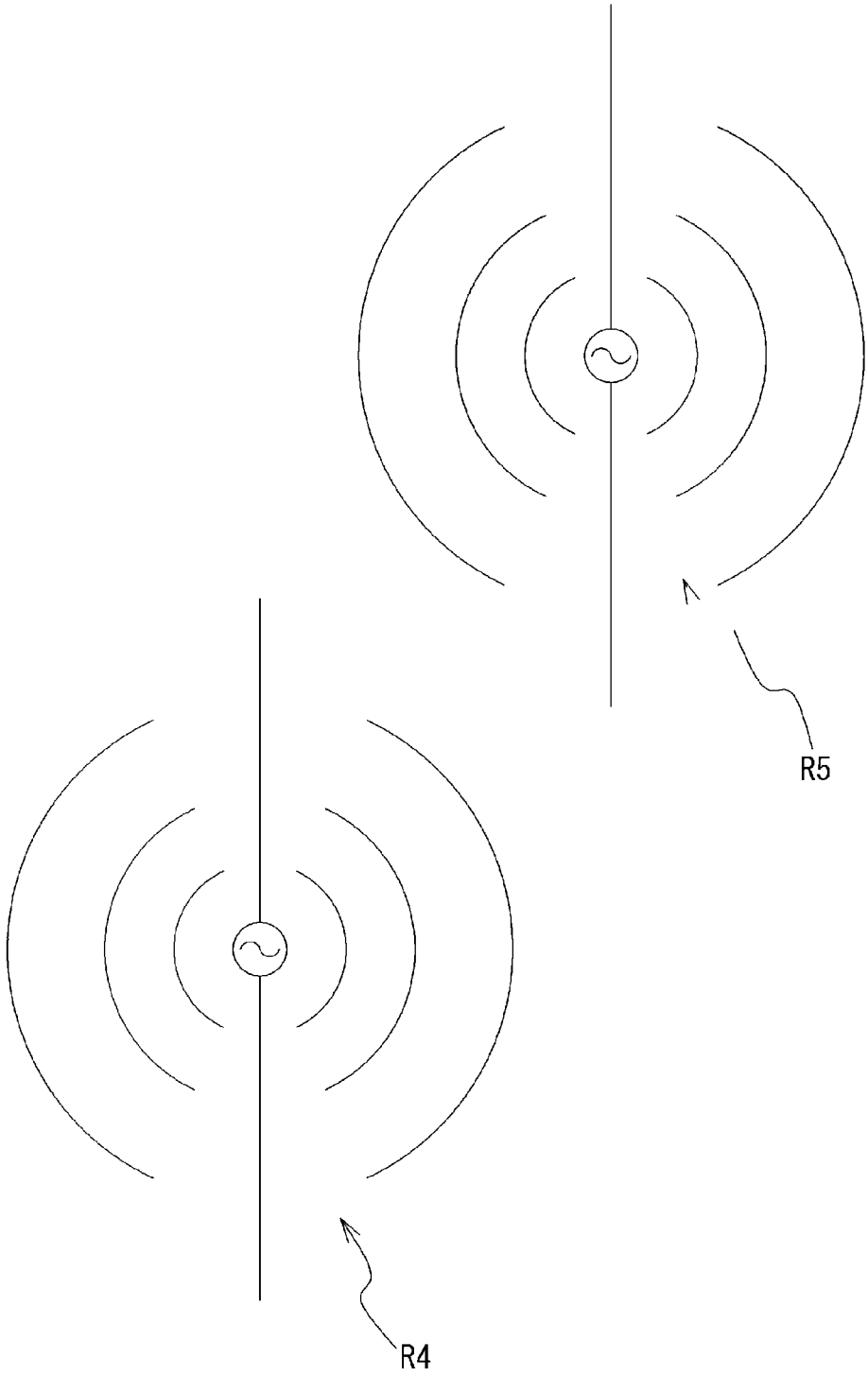
FIG. 9 is a view depicting an outline of a radiating pattern radiated by an antenna element of an antenna device of the comparison example.

FIG. 9 depicts an outline of a radiating pattern radiated by an antenna element of the comparison example. It should be noted that current is assumed to flow in a line to facilitate understanding of the embodiment. As illustrated in FIG. 9, radiating patterns R4 and R5 are approximately equal. As a result, the correlation increases between first and second antenna elements 40 and 50, and therefore the performance of antenna device 1X can be lowered. For example, one of first and second antenna elements 40 and 50 can receive a signal which the other should receive. Even though first and second antenna elements 40 and 50 respectively use different frequencies, when the bandwidths of the different frequencies are overlapped, the performance can be lowered.

The embodiment provides an antenna device in which a radiating pattern is controlled to reduce a correlation between two antenna elements and a wireless communication apparatus.

According to the embodiment, parasitic element 60 is placed near second antenna element 50. When a current is applied to second antenna element 50, a current flows in the direction D2 on parasitic element 60. Second antenna element 50 and parasitic element 60 work as an antenna, while first antenna element 40 and ground 60 work as the other antenna. The embodiment prevents two currents from flowing through ground 30. As illustrated in FIG. 6, different radiating patterns R4 and R5 are generated. The different radiating patterns R4 and R5 reduce the correlation between first and second antenna elements 40 and 50. Even if first and second power feed parts 24 and 25 are spaced close together placed, radiating patterns generated by two antenna elements 40 and 50 are controlled to reduce the correlation between antenna elements 40 and 50. Thus, if two antenna elements 40 and 50 is formed in a narrow space, the correlation between antenna elements 40 and 50 is reduced.

Further, parasitic element 60 will be described in detail below. An interval C between second power feed part 25 which applies power to second antenna element 50 and parasitic element 60 is set to ¼ and less of the working wavelength of second antenna element 50. A length of parasitic element 60 is set to be more approximate to the ¼ wavelength than length A of short side 32*a*. As a result, a current can be applied to parasitic element 60. Parasitic element 60 is not parallel to short side 32*a*. If parasitic element 60 is parallel to short side 32*a*, two currents, which flow through parasitic element 60 and short side 32*a*, are parallel, and therefore the radiating patterns of first and second antenna elements are similar patterns. Consequently, the correlation between first and second antenna elements may increase. It should be noted that the length of parasitic element 60 may be at least 0.2 but no more than 0.3 of the wavelength.

The embodiment reduces the correlation between first and second antenna elements 40 and 50, even if first and second power feed parts 24 and 25 which respectively feed power to first and second antenna elements 40 and 50 are closely placed on ground 30.

Figure 10A:
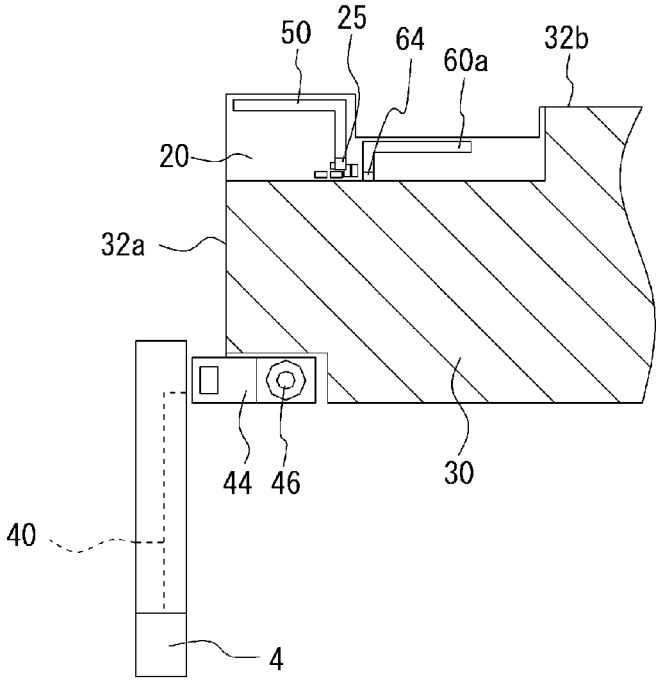
FIG. 10A is an illustrative view depicting a first modified example.

FIG. 10A is a view of a first modified example of the embodiment. Parasitic element 60*a* is shorter than parasitic element 60. However, lumped parameter element 64 is formed to an end of parasitic element 60*a*. Parasitic element 60*a* is connected to ground 30 through lumped parameter element 64. Lumped parameter element 64 is, for example, a coil or an inductor. Parasitic element works as an element having longer electric length by connecting the coil or inductor to the parasitic element. Thus, the length of parasitic element 60*a* is controlled by connecting lumped parameter element 64 to parasitic element 60*a*. Even if a space on support board 20 is narrow to place a parasitic element, a desired electric length of the parasitic element is realized by connecting the coil or the inductor to parasitic element 60*a*. It should be noted lumped parameter element 64 may be a capacitor.

Figure 10B:
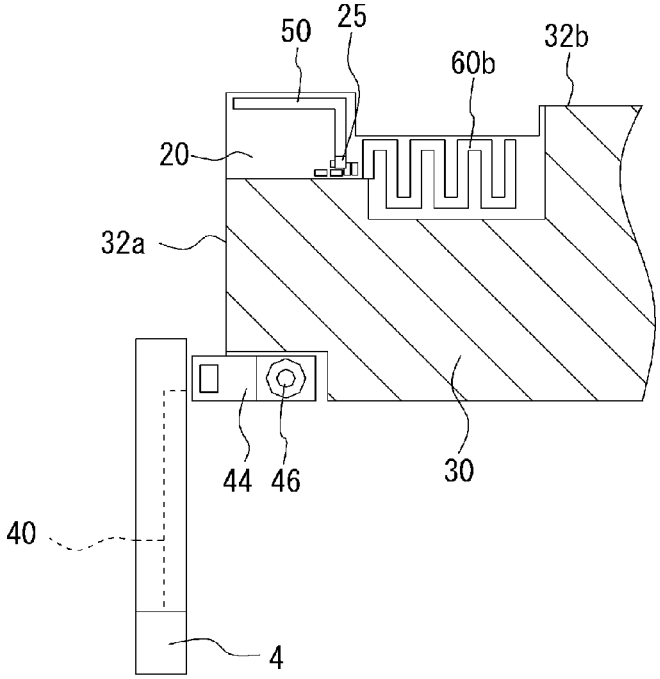
FIG. 10B is an illustrative view depicting a second modified example.

FIG. 10B is a view of a second modified example of the embodiment. As depicted in FIG. 10B, meander-shaped parasitic element 60*b* may be formed as a parasitic element. Meander-shaped parasitic element 60*b* secures the necessary length of a parasitic element. The parasitic element may be spiral-shaped.

If the parasitic element is not parallel to short side 32*a* which has a length close to the ¼ wavelength, Any angle may be set between the parasitic element and short side 32*a*.

Figure 11:
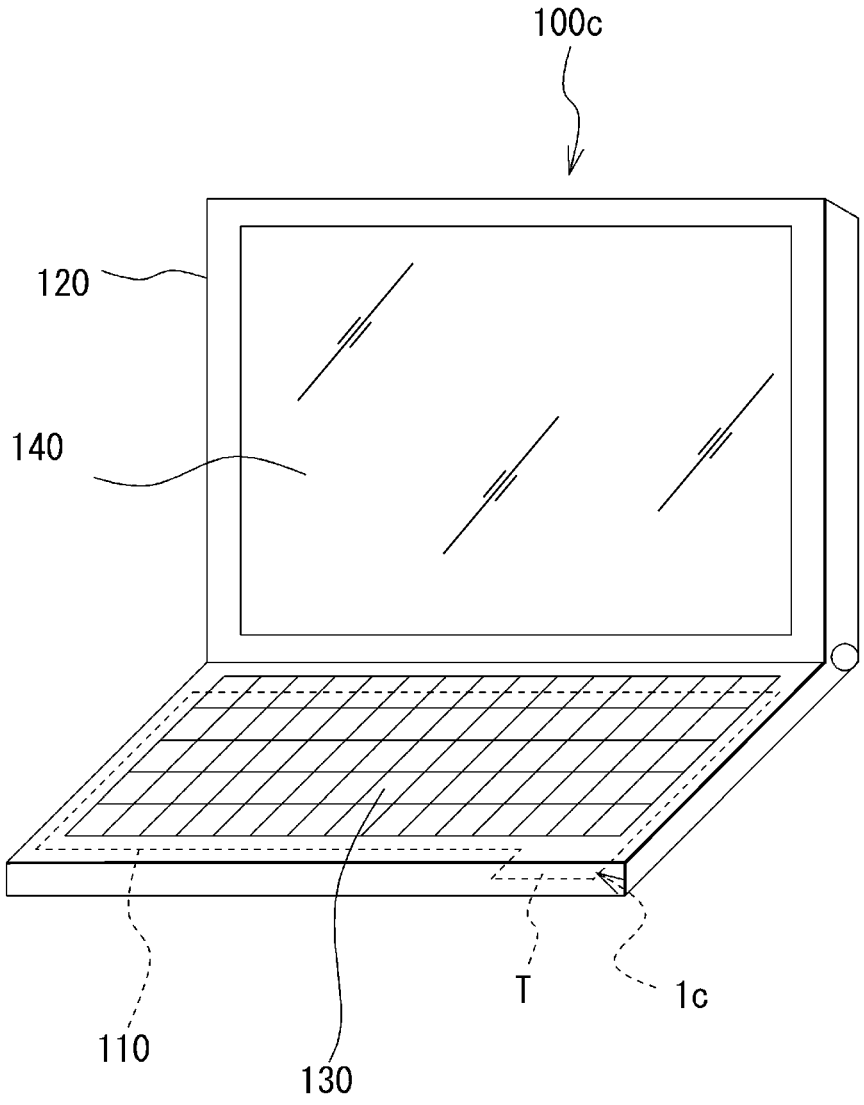
FIG. 11 is an illustrative view depicting an antenna device of a second embodiment.
Figure 12:
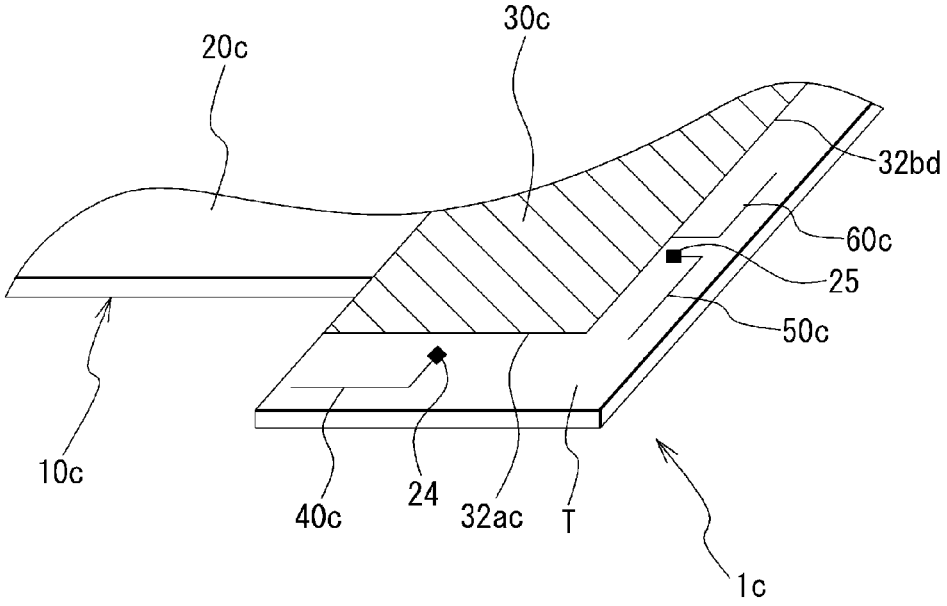
FIG. 12 is an enlarged view of a projecting part of a printed circuit board of the second embodiment.

FIGS. 11 and 12 depict an antenna device of a second embodiment. FIG. 12 is an enlarged view of a part in FIG. 11. As illustrated in FIG. 11, antenna device 1*c* is formed on printed board 10*c* which is placed in main unit 110 of wireless communication apparatus 100*c*. Printed board 10*c* has about a rectangular board with a projecting part T to a corner of the board 10*c*. Projecting part T projects outward from the other parts of printed board 10*c*. In the second embodiment, printed board 10*c* is a mother board of wireless communication apparatus 100*c*. However, printed board 10*c* may be a printed board other than the mother board.

First antenna element 40*c* is formed by short side 32*ac* on support board 20*c*. Second antenna element 50*c* and parasitic element 60*c* is formed by long side 32*bc* on support board 20*c*. A length of first antenna element 40*c* is approximately ¼ of a wavelength used by first antenna element 40*c*. A length of second antenna element 50*c* and a length of parasitic element 60*c* have approximately ¼ of wavelength used by antenna element 50*c*.

An interval between parasitic element 60*c* and second power feed part 25 is less than or equal to ¼ of wavelength used by antenna element 50*c*. First antenna element 40*c* and ground 30*c* are cooperated to work as an antenna. Second antenna element 50*c* and parasitic element 60*c* are cooperated to work as an antenna. Thus, antenna device 1*c* can be formed on printed board 10*c* of the wireless communication apparatus 100*c*. Antenna device 1*c* reduces the correlation between first and second antenna element 40*c* and 50*c*. Consequently, when first and second antenna element 40*c* and 50*c* is closely placed with each other due to other components mounted on printed board 10*c*, the correlation between first and second antenna element 40*c* and 50*c* can be reduced.

In the embodiments, the wavelengths used by the first and second antenna elements can be the same or different.

According to the embodiments, the first and second antenna elements are not connected to the ground. However, at least one of the first and second antenna elements can be connected to the ground.

In the embodiments, the notebook computer is described as the wireless communication apparatus. However, a portable communication device, such as a cellular phone, personal digital assistant (PDA) or portable navigation device may be used as the wireless communication apparatus. Further, a floor-type communication device, such as a desktop personal computer, may be used as the wireless communication apparatus.

In the embodiments, antenna element 50 is a conductive pattern formed on support board 20, but not limited to. Antenna element 50 may be a rod-type antenna or a helical-type antenna. Antenna element 40 of the first embodiment is a rod-type antenna or a helical-type antenna, but is not limited thereto. Antenna element 40 may be a conductive pattern formed on support board 20.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiments of the present inventions have been described in detail, it should be understood that the various changes, substitutions, and alterations could be made hereto without departing from the spirit and scope of the invention.

What is claimed is:

1. An antenna device comprising:

a board made of dielectric material, having first and second power feed parts;

a first antenna element connected to the first power feed part, using a first wavelength;

a second antenna element formed by printed wiring and connected to the second power feed part, using a second wavelength;

a ground formed on the board, having a first side and a second side respectively having different lengths and extending in different directions, the length of the first side, compared with the length of second side, being more approximate to ¼ length of the first wavelength and ¼ length of the second wavelength; and a parasitic element that is a strip formed by printed wiring and connected to the second side of the ground, not parallel to the first side of the ground, a length of the parasitic element being approximate to ¼ length of the second wavelength and an interval of the parasitic element and the second power feed part being not more than the ¼ length of the second wavelength.

2. The antenna device according to claim 1, wherein the length of the parasitic element is more approximate to the ¼ length of the second wavelength than the length of the first side of the ground.

3. The antenna device according to claim 1, wherein the length of the parasitic element is not less than 0.2 and not more than 0.3 of the ¼ length of the second wavelength.

4. The antenna device according to claim 1, wherein the parasitic element is connected to the ground through a lumped parameter element.

5. The antenna device according to claim 1, wherein the parasitic element is meander-shaped or spiral.

6. A wireless communication apparatus including an antenna device, the antenna device comprising:

a board made of dielectric material, having first and second power feed parts;

a first antenna element connected to the first power feed part, using a first wavelength;

a second antenna element formed by printed wiring and connected to the second power feed part, using a second wavelength;

a ground formed on the board, having a first side and a second side respectively having different lengths and extending in different directions, the length of the first side, compared with the length of second side, being more approximate to ¼ length of the first wavelength and ¼ length of the second wavelength; and a parasitic element that is a strip formed by printed wiring and connected to the second side of the ground, not parallel to the first side of the ground, a length of the parasitic element being approximate to ¼ length of the second wavelength and an interval of the parasitic element and the second power feed part being not more than the ¼ length of the second wavelength.

* * * * *